US005973452A

United States Patent [19]

Bojkov et al.

[11] Patent Number: 5,973,452

[45] Date of Patent: Oct. 26, 1999

[54] DISPLAY

[75] Inventors: Christo P. Bojkov, Hillsboro, Oreg.; Richard Lee Fink, Austin, Tex.; Nalin Kumar, Austin, Tex.; Alexei Tikhonski, Austin, Tex.; Zvi Yaniv, Bloomfield Hills, Mich.

[73] Assignee: SI Diamond Technology, Inc., Austin, Tex.

[21] Appl. No.: 08/922,842

[22] Filed: Aug. 26, 1997

Related U.S. Application Data

[60] Provisional application No. 60/029,922, Nov. 1, 1996.

[51] Int. Cl.[6] ..... H01J 1/30

[52] U.S. Cl. ..... 313/495; 313/309; 313/346 R; 313/496; 313/310; 313/311; 313/336; 313/351

[58] Field of Search ..... 313/309, 310, 313/336, 351, 495, 496, 422, 346 R, 311

[56] References Cited

U.S. PATENT DOCUMENTS

| | | | |
|---|---|---|---|
| 5,612,712 | 3/1997 | Kumar et al. | 313/495 |
| 5,619,092 | 4/1997 | Jaskie | 313/309 |
| 5,637,950 | 6/1997 | Jin et al. | 313/310 |
| 5,659,224 | 8/1997 | Kumar et al. | 313/310 |
| 5,675,216 | 10/1997 | Kumar et al. | 313/495 |
| 5,686,791 | 11/1997 | Kumar et al. | 313/495 |
| 5,703,435 | 12/1997 | Kumar et al. | 313/495 |

*Primary Examiner*—Ashok Patel

*Attorney, Agent, or Firm*—Kelly K. Kordzik; Winstead Sechrest & Minick P.C.

[57] ABSTRACT

The present invention provides for a field emission device including an anode assembly and a cathode assembly, wherein the cathode assembly further includes a substrate, a plurality of electrically conducting strips deposited on the substrate, and a continuous layer of diamond material deposited over the plurality of electrically conducting strips and portions of the substrate exposed between the plurality of electrically conducting strips. The field emission device may further include a grid assembly including a perforated silicon substrate, a first dielectric layer deposited on the silicon substrate, and a first conducting layer deposited on the first dielectric layer, wherein the first dielectric layer and the first conducting layer have perforations coinciding with perforations of the silicon substrate. The grid assembly may further include a second dielectric layer deposited on an underside of the silicon substrate, wherein the second dielectric layer has perforations coinciding with perforations of the silicon substrate.

18 Claims, 12 Drawing Sheets

DISPLAY

This is a continuation-in-part application of U.S. provisional patent application Ser. No. 60/029,922, filed Nov. 1, 1996.

CROSS-REFERENCE TO RELATED APPLICATIONS

The present invention relates to U.S. patent application Ser. No. 08/920,011 entitled "A CATHODE ASSEMBLY" now allowed, U.S. patent application Ser. No. 08/706,077 entitled "HIGH INTENSITY LAMP, and U.S. patent application Ser. No. 08/699,119, entitled "BACKLIGHTS FOR COLOR LIQUID CRYSTAL DISPLAYS" now aabandoned, which are hereby incorporated by reference herein.

TECHNICAL FIELD

The present invention relates in general to field emission devices, and more particularly, to field emission displays.

BACKGROUND INFORMATION

It has been discovered that certain diamond films with nanocrystalline diamond grains and with an inter-grain material consisting of a mixture of sp2 and sp3 structures are poor electron emitters, or do not emit electrons at all, after processing of the structure containing the diamond film with standard microelectronics processes, such as patterning, etching, and photolithography. Prior art techniques for utilizing diamond films as electron emitters within lamps or flat panel displays require such microelectronics processes in order to achieve the desired pixel structure for the lamp or a display. As a result, what is needed in the art is a structure and a method for manufacturing such a structure that does not require the application of such microelectronics processes on the diamond films.

SUMMARY OF THE INVENTION

The present invention addresses the foregoing need by providing for a field emission device comprising an anode assembly and a cathode assembly, wherein the cathode assembly further comprises a substrate, a plurality of electrically conducting strips deposited on the substrate, and a continuous layer of diamond material deposited over the plurality of electrically conducting strips and portions of the substrate exposed between the plurality of electrically conducting strips.

The field emission device may further include a grid assembly comprising a perforated silicon substrate, a first dielectric layer deposited on the silicon substrate, and a first conducting layer deposited on the first dielectric layer, wherein the first dielectric layer and the first conducting layer have perforations coinciding with perforations of the silicon substrate.

The grid assembly may further comprise a second dielectric layer deposited on an underside of the silicon substrate, wherein the second dielectric layer has perforations coinciding with perforations of the silicon substrate.

The diamond film does not have to undergo post-processing microelectronics processes, which may be destructive to the emission properties of the diamond film.

The diamond film may be deposited using well-known processes. The diamond film may comprise CVD diamond or it may comprise Amorphic diamond having $sp^2$ and $sp^3$ structures. The diamond films could also be electrophoretically deposited diamond particles onto conductive substrates.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
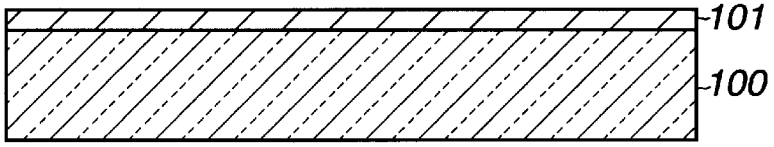
FIG. 1 illustrates a substrate coated with a conductive layer.

In the following description, numerous specific details are set forth such as materials and dimensions, etc. to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Referring to FIG. 1, there is illustrated substrate 100 having conductive (e.g., metal) layer 101 deposited thereon using any well-known process for depositing such a conductive layer on a substrate, such as sputtering, chemical vapor deposition (CVD) or evaporation. The substrate may consist of glass, ceramics (forsterite or alumina) or some other insulating material. Conductive layer 101 may be comprised of Ti, TiW, Cr, Mo, W, or a multi-layer configuration of these or other types of conducting films.

Figure 2:
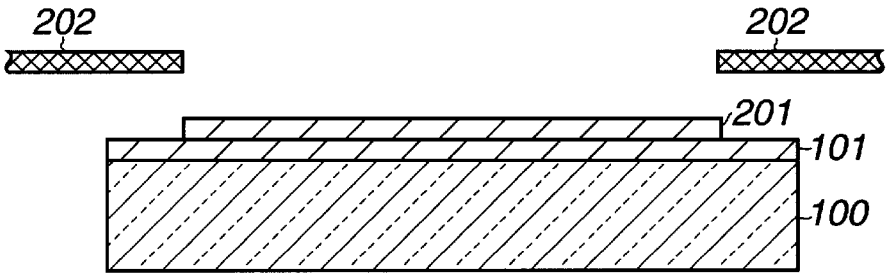
FIG. 2 illustrates the depositing of a diamond layer on the conductive layer.

Referring next to FIG. 2, a continuous film of diamond 201 is deposited onto conductive layer 101 through a shadow mask 202, which may be held in place over the substrate using any well-known method. The diamond film 201 may comprise a nanocrystalline or microcrystalline material, and may contain sp2 and sp3 structures. For a further discussion of diamond films, please refer to U.S. Pat. No. 5,548,185, or U.S. patent application Ser. No. 08/485,954, which are hereby incorporated by reference herein.

Figure 4:
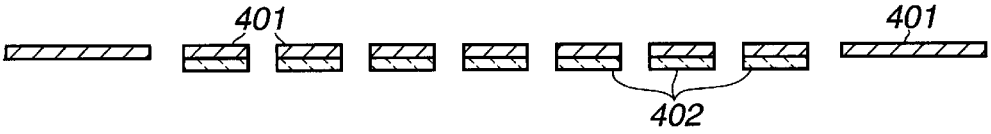
FIG. 4 illustrates a grid.

Referring next to FIG. 4, there is illustrated grid 401, which may comprise any conductive (e.g., metal) material, such as the materials listed above for conductive layer 101. Using a technique well-known in the art, dielectric material 402 is deposited onto the intersecting portions of grid 401. The dielectric, or insulating, material may be comprised of $SiO_x$, $Si_xNy$, silicon oxi-nitride, or a metal oxide. A shadow mask may be used during such a deposition process.

Figure 3:
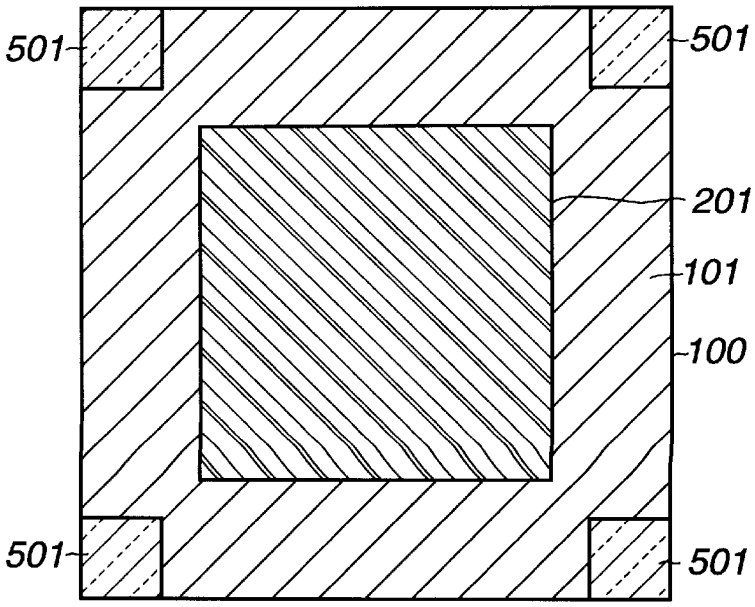
FIG. 3 illustrates a top view of the cathode structure of the lamp in accordance with the present invention.
Figure 5:
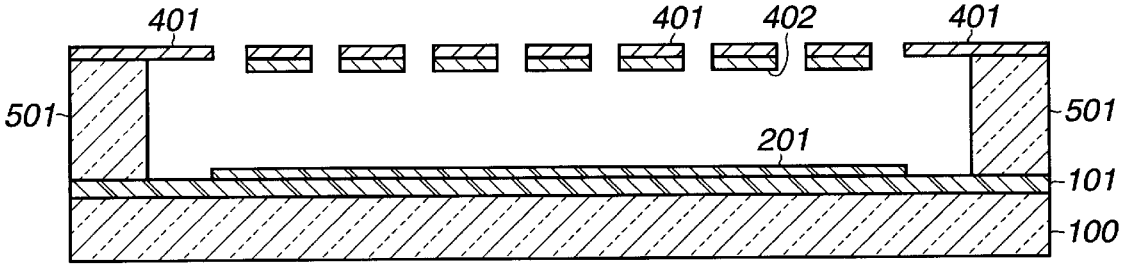
FIG. 5 illustrates construction of the grid and the cathode in accordance with the present invention.

Referring next to FIG. 5, there is illustrated a cross-section of the manufacturing of the grid and cathode portions, while also showing how grid 401 is supported by pillars 501. Pillars 501 may be comprised of a ceramic or a glass material, which is mechanically adhered to conductive layer 101. Likewise, grid 401 is mechanically adhered to pillars 501. FIG. 3 illustrates a possible arrangement of pillars 501 with respect to substrate 100 and cathode (diamond) layer 201.

Figure 6:
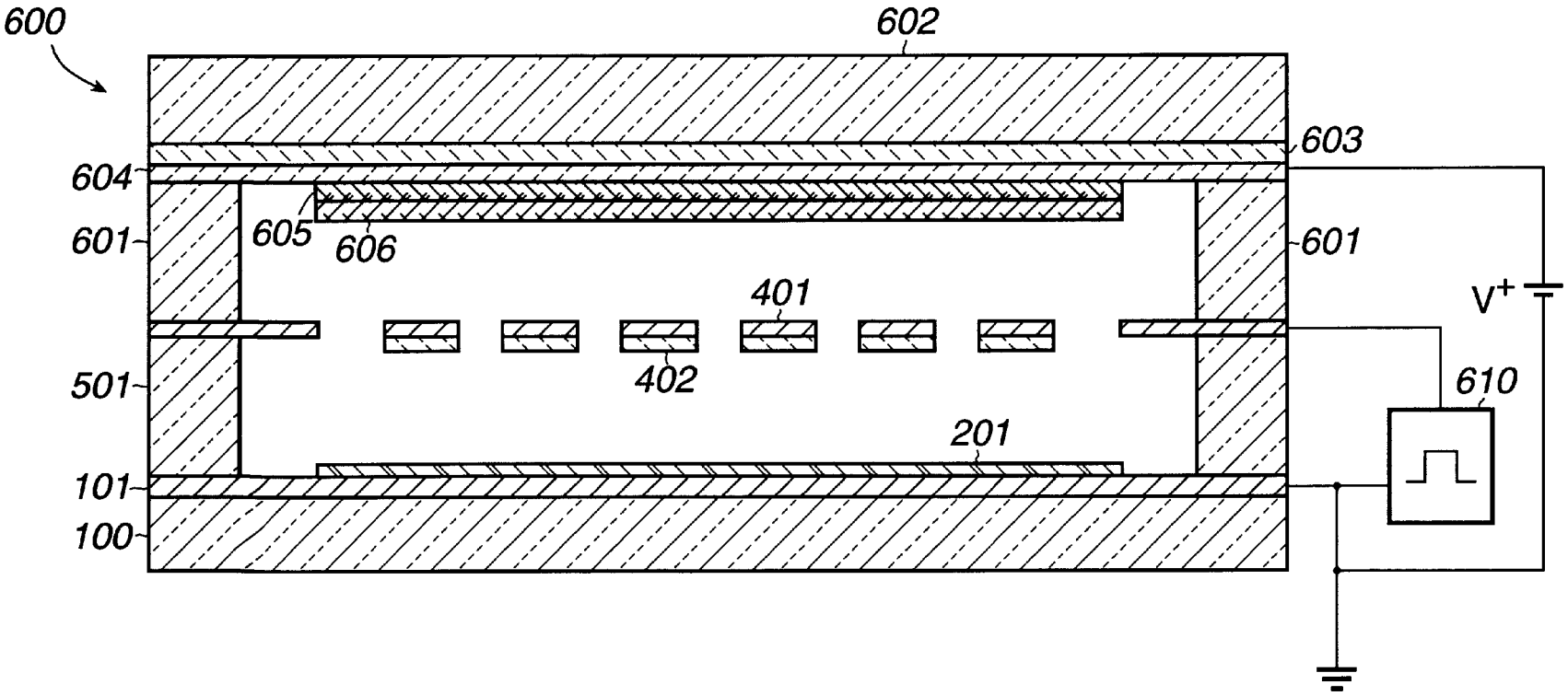
FIG. 6 illustrates a lamp configured in accordance with the present invention.

Referring next to FIG. 6, there is illustrated a cross-section of a lamp configured in accordance with the present invention. In this illustration of FIG. 6, anode 600 has been combined with the structure illustrated in FIG. 5.

Anode 600 may be comprised of one of various well-known anode structures. For example, anode 600 includes glass substrate 602 having dielectric material 603 deposited thereon. Then, indium-tin oxide (ITO) layer 604 is deposited on dielectric layer 603. Phosphor 605 is then deposited on ITO layer 604, possibly using a shadow mask (not shown) in order to ensure that the size of phosphor layer 605 corresponds to the size of diamond layer 201. Optionally, a 500 angstrom layer 606 of aluminum may be applied to cover the phosphor layer 605 when higher than 5 KV voltages are applied.

Dielectric layer 603 may be comprised of one of the listed dielectric materials noted above with respect to dielectric 402. ITO may have a sheet resistance of 5–20 ohms per centimeter.

Separation of anode 600 from grid 401 is provided by pillars 601, which may be comprised of a ceramic or glass material, such as pillars 501.

The lamp illustrated in FIG. 6 is activated by applying a ground potential to conductive layer 101 and extracting electrons from diamond layer 201 by applying a DC, AC, or pulse voltage signal using voltage source 610, to grid 401. Electrons will be extracted from diamond layer 201, and will accelerate through the holes of grid 401 toward phosphor layer 605. A constant DC voltage is applied between ITO 604 and ground, or the cathode.

Simulations have shown that optimal emission of electrons may be achieved where the dimension of the openings in grid 401 are on the same order of scale as the distance between grid 401 and cathode layer 201. A number of grid technologies may be used such as perforated silicon, perforated metal foils, or any conductive material whereby the opening in the grid is from 1 to 1000 microns.

The anode to cathode voltage (V) may comprise a 5–50 kilovolt signal.

A high brightness lamp, such as the one shown in FIG. 6, can be achieved even with low emission site density because the electron optics involved achieve expansion of the electron beam emitted from cathode layer 201 by grid 401. This results in uniform illumination of anode 600.

Figure 7:
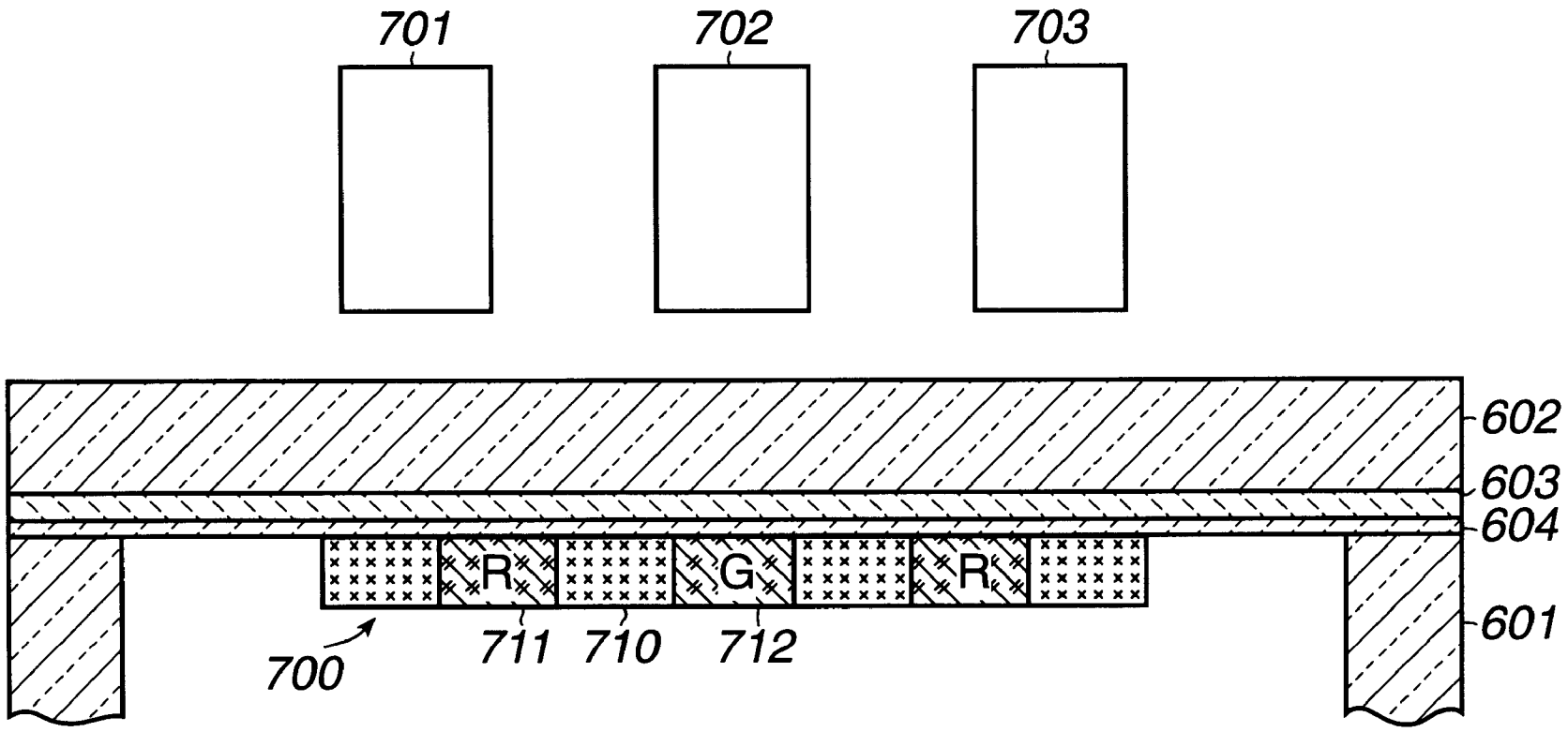
FIG. 7 illustrates an alternative embodiment of an anode in accordance with the present invention.

Referring next to FIG. 7, there is illustrated an alternative embodiment of anode 600. Such an alternative anode embodiment may be utilized within a liquid crystal display (LCD), such as the one disclosed within U.S. patent application Ser. No. 08/699,119 now abandoned. The electrons from cathode layer 201 (not shown) will strike phosphor layer 700 exciting red phosphors 711 and green phosphors 712 deposited between black matrix coatings 710. These red, green and blue (not shown) phosphors will then emit their corresponding photons towards corresponding liquid crystal sub-pixels 701–703, which are not described in any further detail herein, but are described within the cross-referenced U.S. patent application Ser. No. 08/699,119.

Figure 8:
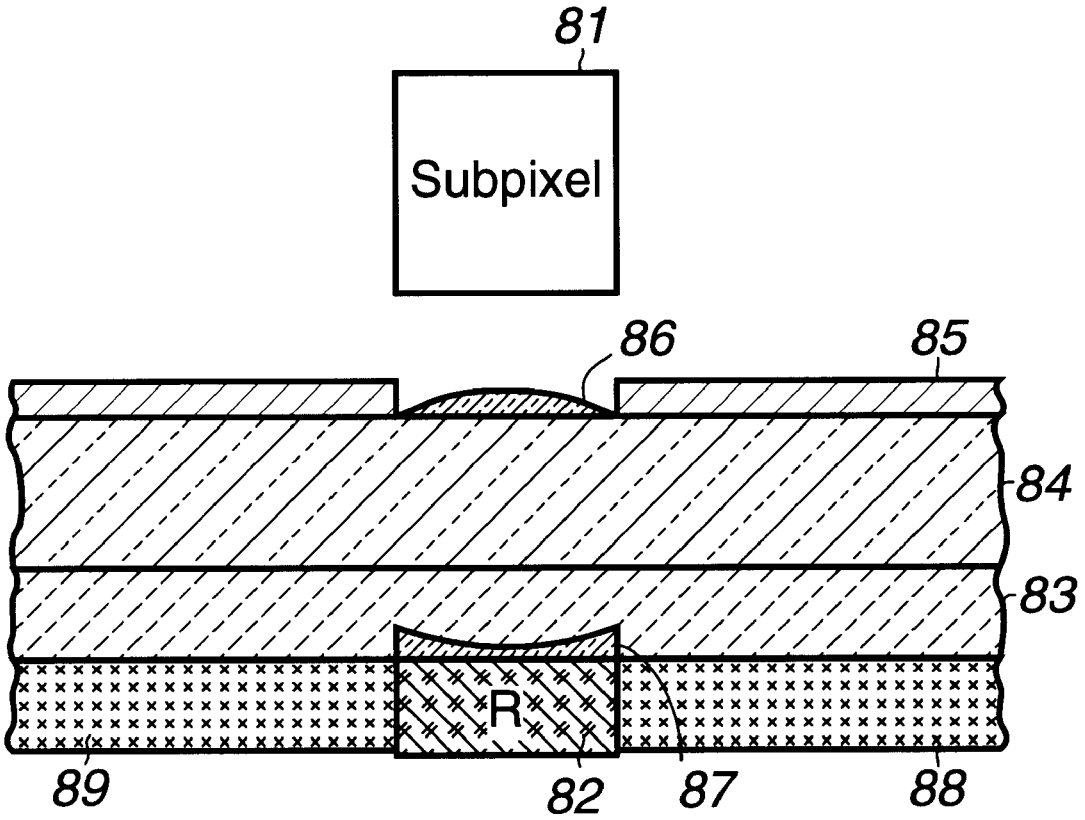
FIG. 8 illustrates another alternative embodiment of an anode in accordance with the present invention.

Referring next to FIG. 8, there is illustrated a further alternative embodiment of an anode, which may be utilized with the field emission lamp of the present invention. Illustrated is a portion of an anode assembly, illustrating one sub-pixel 81 illuminated by photons produced by phosphor 82. Since the light (photons) emitted from phosphor 82 will disperse through ITO 83 and substrate 84 in all directions, focusing lens 86 and 87 may be utilized separately or in combination to focus the emitted light onto sub-pixel 81. Note that phosphor 82 is deposited between black matrix portions 88 and 89.

Figure 10:
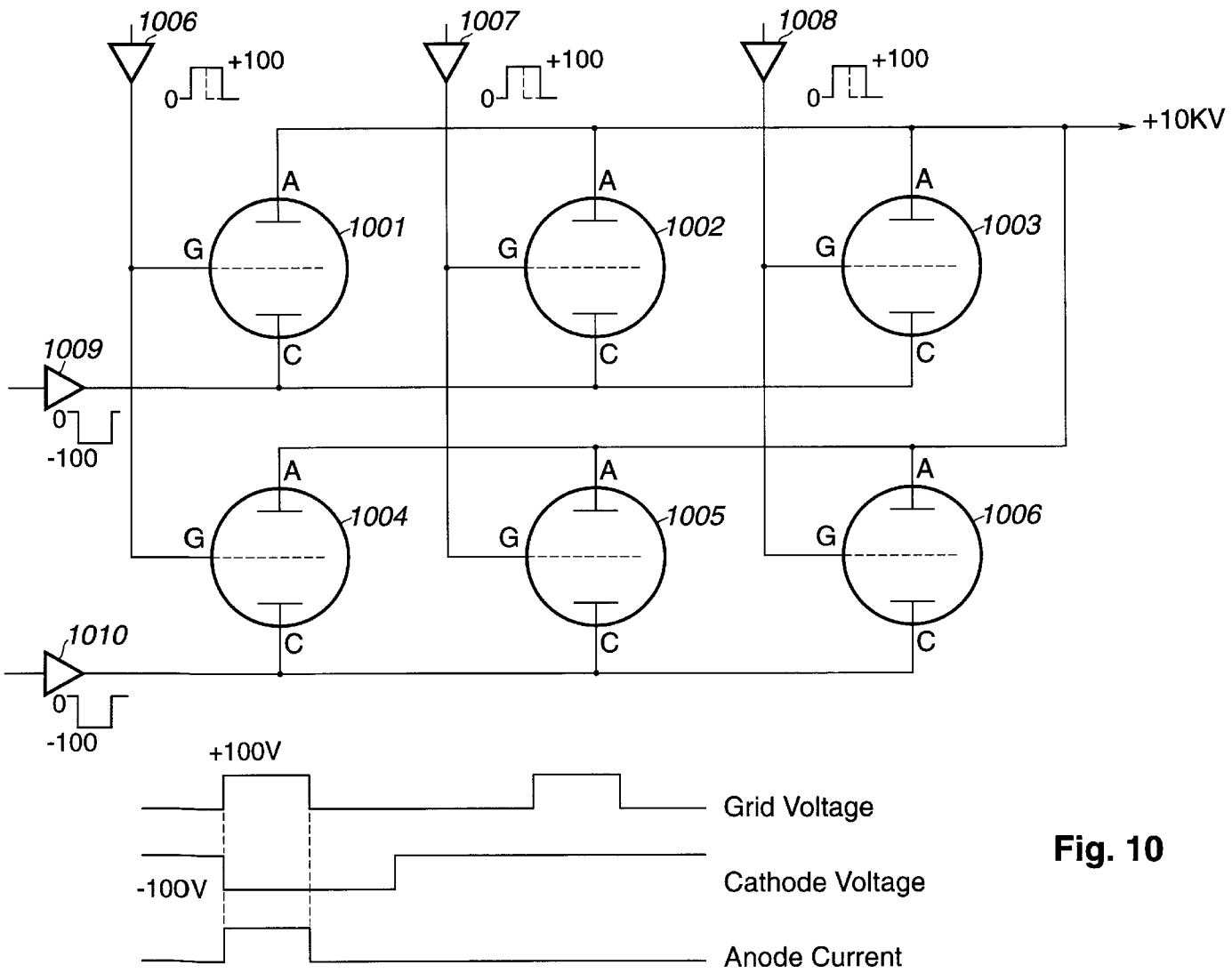
FIG. 10 illustrates a matrix-addressable display comprising lamps.

Referring next to FIG. 10, there is illustrated a schematic diagram of the use of lamps configured in accordance with the present invention within a flat panel display, billboard, or some other type of matrix-addressable display. Each lamp 1001–1006 may be configured in accordance with the lamp shown in FIG. 6 having an anode, cathode, and grid. In FIG. 10, the anodes are designated with an "A", the cathodes are designated with a "C", and the grids are designated with a "G".

Each of the anodes are coupled to a 10 kilovolt source, while the grids of lamps 1001 and 1004 are driven by driver 1011, the grids of lamps 1002 and 1005 are driven by driver 1007, the grids of lamps 1003 and 1006 are driven by driver 1008, the cathodes of lamps 1001–1003 are driven by driver 1009, and the cathodes of lamps 1004–1006 are driven by driver 1010. Note that to activate a particular lamp, such as lamp 1001, a positive pulse is emanated from driver 1011 to the grid of lamp 1001, while a corresponding negative pulse is driven from driver 1009 to the cathode of lamp 1001. This will cause electrons to emit from the cathode of lamp 1001 to its anode. The lower part of FIG. 10 illustrates how such pulses may be timed in order to generate an image selectively from a particular lamp, or pixel.

Figure 9:
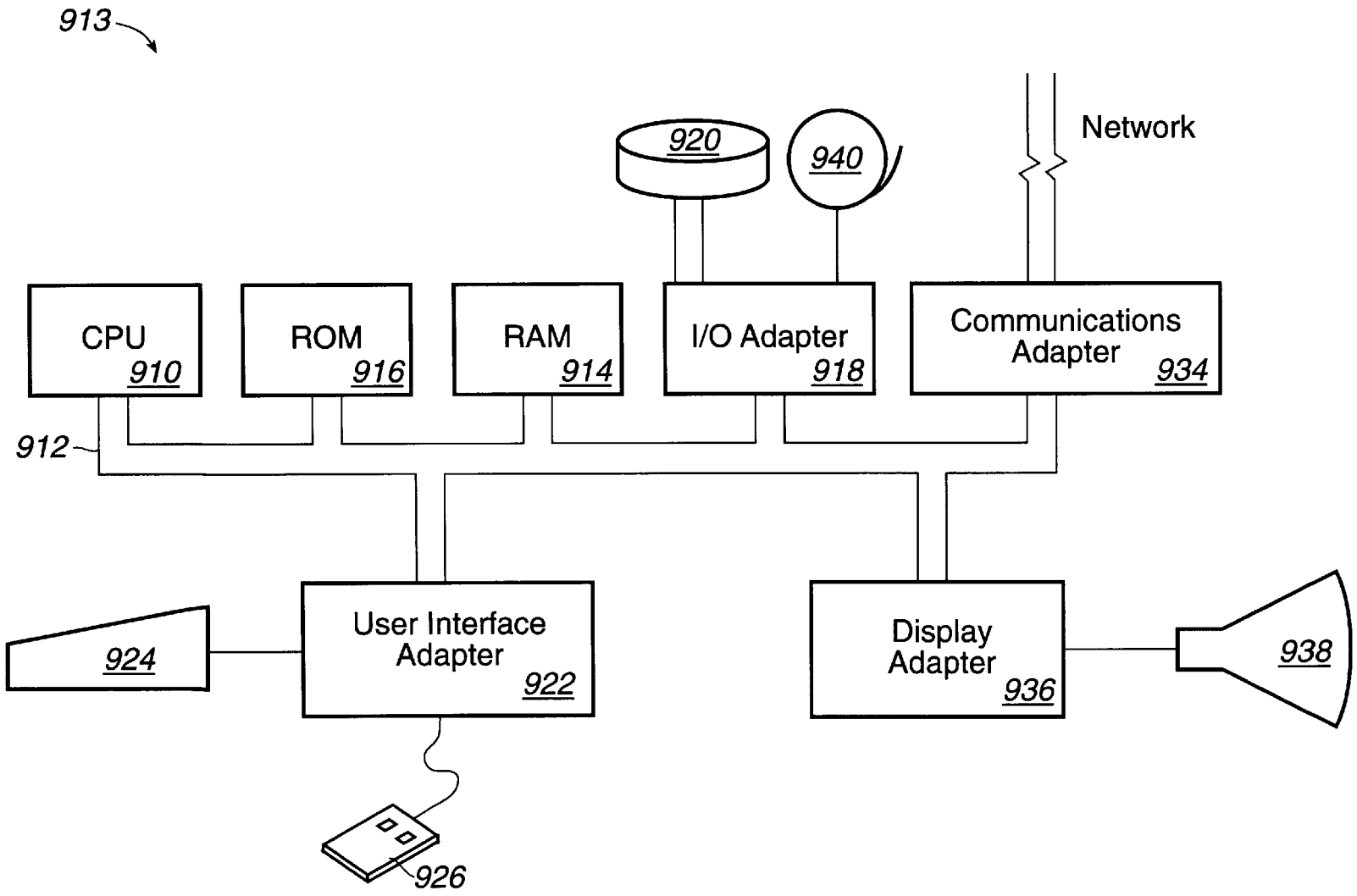
FIG. 9 illustrates a data processing system configured in accordance with the present invention.

A representative hardware environment for practicing the present invention is depicted in FIG. 9, which illustrates a typical hardware configuration of a data processing system 913 in accordance with the subject invention having central processing unit (CPU) 910, such as a conventional microprocessor, and a number of other units interconnected via system bus 912. System 913 includes random access memory (RAM) 914, read only memory (ROM) 916, and input/output (I/O) adapter 918 for connecting peripheral devices such as disk units 920 and tape drives 940 to bus 912, user interface adapter 922 for connecting keyboard 924, mouse 926, and/or other user interface devices such as a touch screen device (not shown) to bus 912, communication adapter 934 for connecting system 913 to a data processing network, and display adapter 936 for connecting bus 912 to display device 938.

Display 938 may embody a display of lamps such as those shown in FIG. 6 in order to display images. Display 938 may be a flat panel display or a billboard device. The data processing system illustrated in FIG. 9 may also utilize the display technology described hereinafter with respect to FIGS. 11–22, which describe a method for making and a structure of a matrix-addressable display panel.

Figure 11:
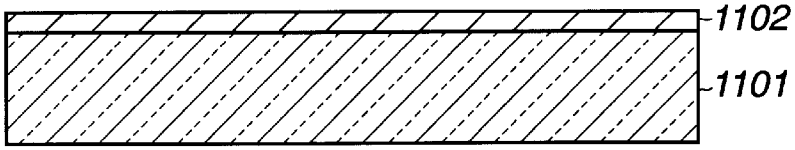
FIGS. 11–15 illustrate the process for producing cathode strips on a substrate.

Referring next to FIG. 11, there is illustrated substrate 1101 having a conductive (e.g., metal) film 1102 deposited thereon using any well-known technique for depositing such a metal film, such as sputtering or evaporation. The substrate, which may comprise a ceramic or glass material, may have a thickness of 1–5 millimeters, while the metal film thickness may be 0.5–1.5 microns.

Figure 12:
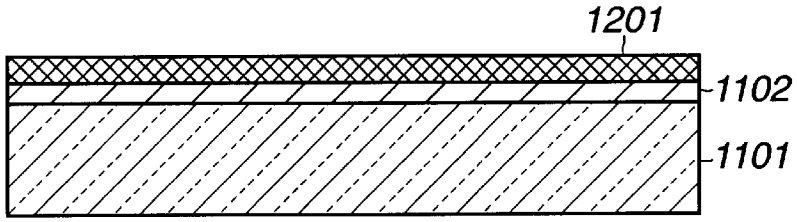
Figure 13:
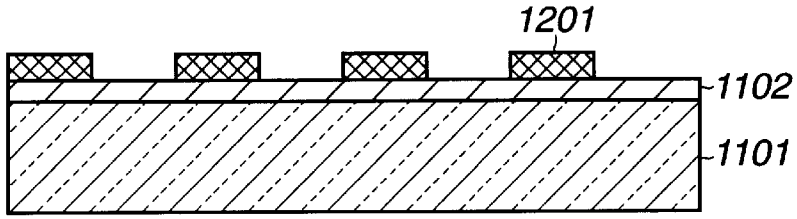
Figure 14:
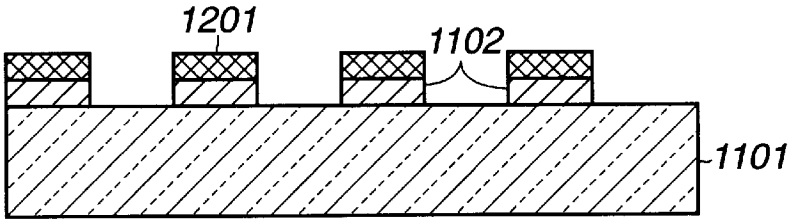
Figure 15:
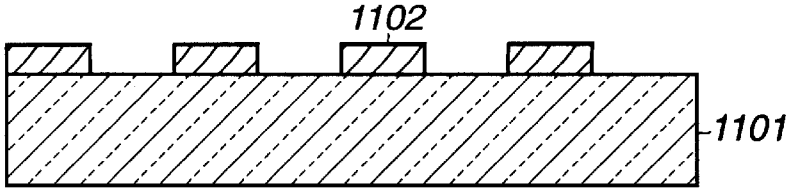

Referring next to FIG. 12, a photoresist 1201 is spin coated onto metal film 1102. Thereafter, in FIG. 13, a mask (not shown) is used to pattern the photoresist 1201 into parallel strips. Then, in FIG. 14, an etching step is utilized to etch portions of the metal layer 1102 between the formed strips. In FIG. 15, the photoresist is then removed, leaving metal strips 1102, which may be approximately 100 microns in width with 10–20 microns of distance between each metal strip.

Figure 16:
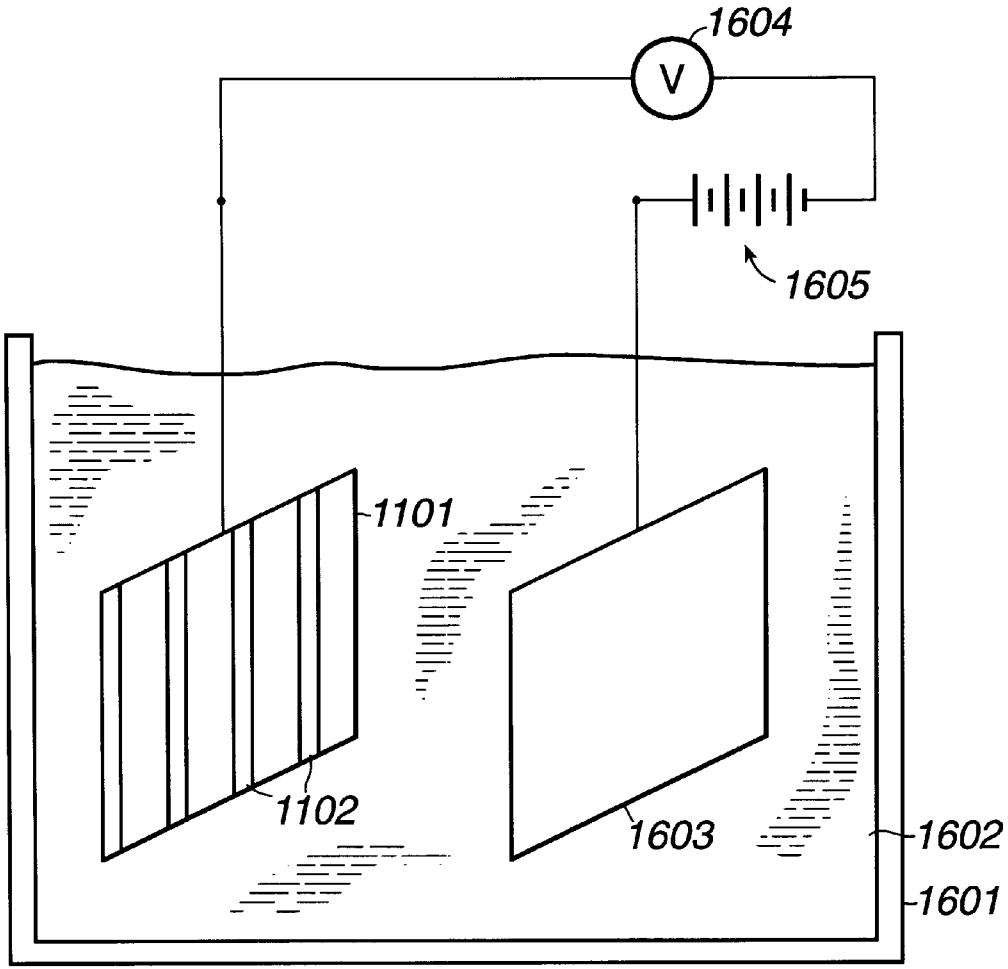
FIG. 16 illustrates an electrophoretic process for depositing diamond particles in a selective manner onto the cathode strips.

The process of selectively seeding diamond particles onto the cathode strips 1102 is illustrated in FIG. 16. The cathode comprising substrate 1101 and metal strips 1102 is placed in a container 1601 containing an organic alcohol solution (isopropyl alcohol, methanol, etc.) 1602, which also contains a charging salt such as Al(NO3)3 or Mg(NO3)2 or La(NO3)3. The anode 1603 may be nickel, stainless steel, or platinum. Diamond particles of a nano-size (powder) are disbursed into solution 1602. Upon applying a negative voltage using power supply 1605 and monitored by voltmeter 1604, onto the cathode, the diamond particles are electrophoretically deposited onto metal lines 1102, thus forming the future centers for preferential diamond growth.

Figure 17:
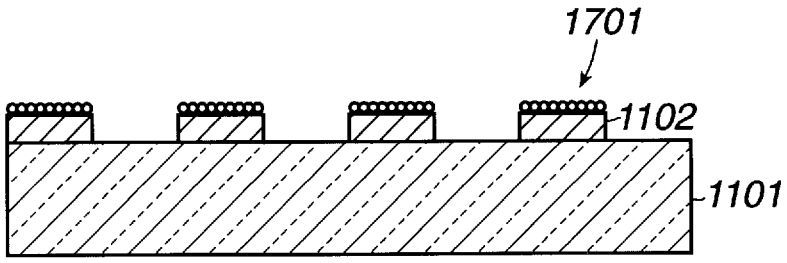
FIG. 17 illustrates the cathode strips with the diamond particles deposited thereon after the process performed in FIG. 16.

The result of this process is illustrated in FIG. 17, which illustrates such nano-size diamond particles 1701 deposited onto metal lines 1102.

Figure 18:
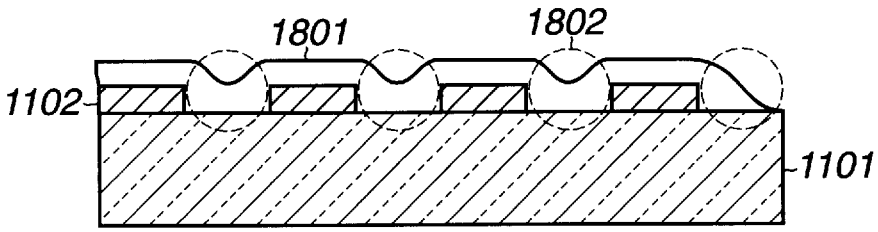
FIG. 18 illustrates the depositing of a diamond film onto the cathode strips and diamond particles illustrated in FIG. 17.
Figure 19:
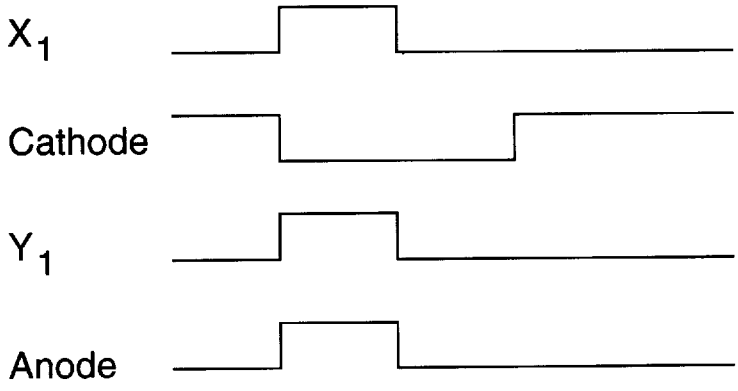
FIG. 19 illustrates driving of a particular pixel within the display illustrated in FIG. 22.

Next, the cathode structure illustrated in FIG. 17 is introduced into a vacuum chamber for chemical vapor deposition (CVD) of diamond, using a process well-known in the art. The process of diamond nucleation occurs primarily onto the diamond particles 1701 forming continuous diamond layer 1801 (FIG. 18). The result of this process is that the areas denoted by the dashed circles 1802 have a much higher resistance than the diamond layer portions residing above the metal lines 1102. This effectively reduces, or eliminates cross-talk between metal lines 1102.

Figure 20:
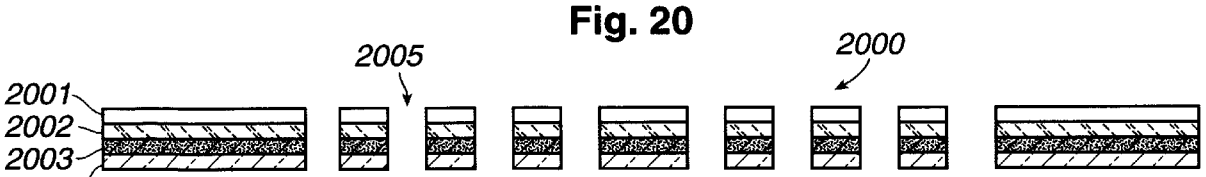
FIG. 20 illustrates a grid utilized within a triode display.
Figure 21:
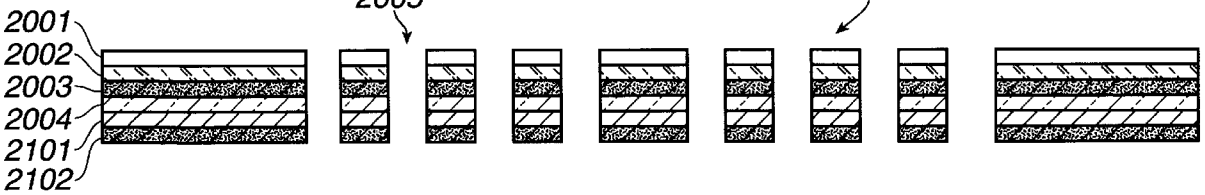
FIG. 21 illustrates a grid utilized within a tetrode display.

Referring next to FIG. 20, there is illustrated grid 2000 manufactured independently from the cathode using typical semiconductor manufacturing processes. First, a silicon substrate 2003, which has been perforated using well-known methods, has deposited thereon a native oxide or some other type of dielectric 2002 using well-known techniques. Then, a conductive layer 2001 is deposited on layer 2002. Furthermore, on the underside of silicon layer 2003, another dielectric material 2004 is deposited. Generally, the width of perforations 2005 is approximately equal to the height of such perforations.

Figure 22:
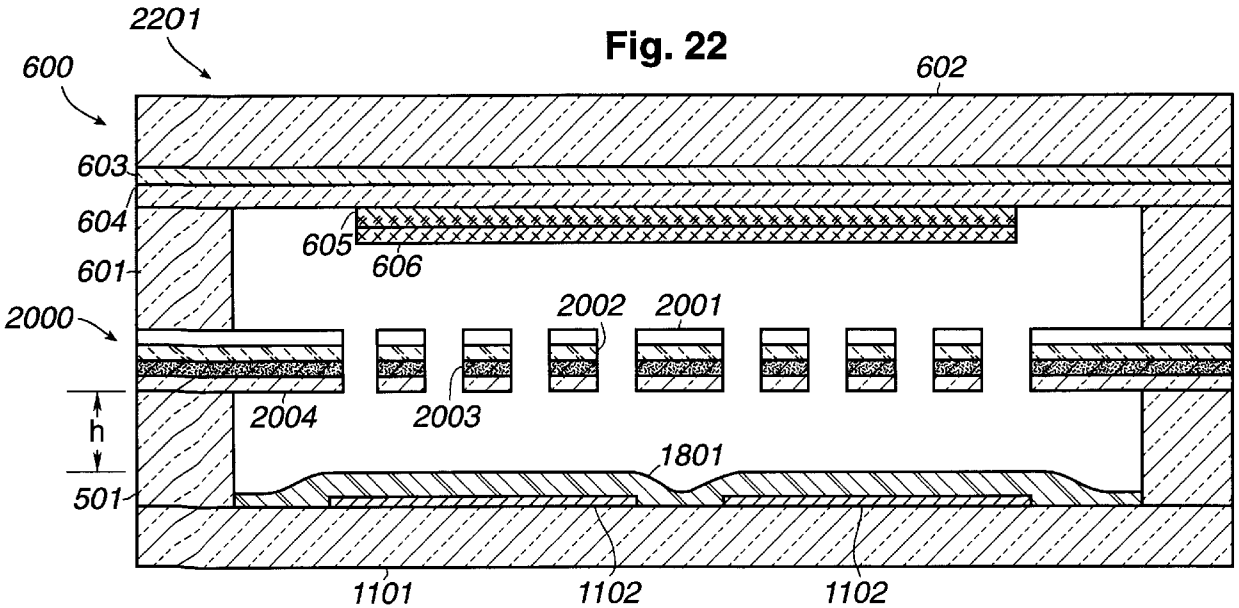
FIG. 22 illustrates a triode display in accordance with the present invention.
Figure 23:
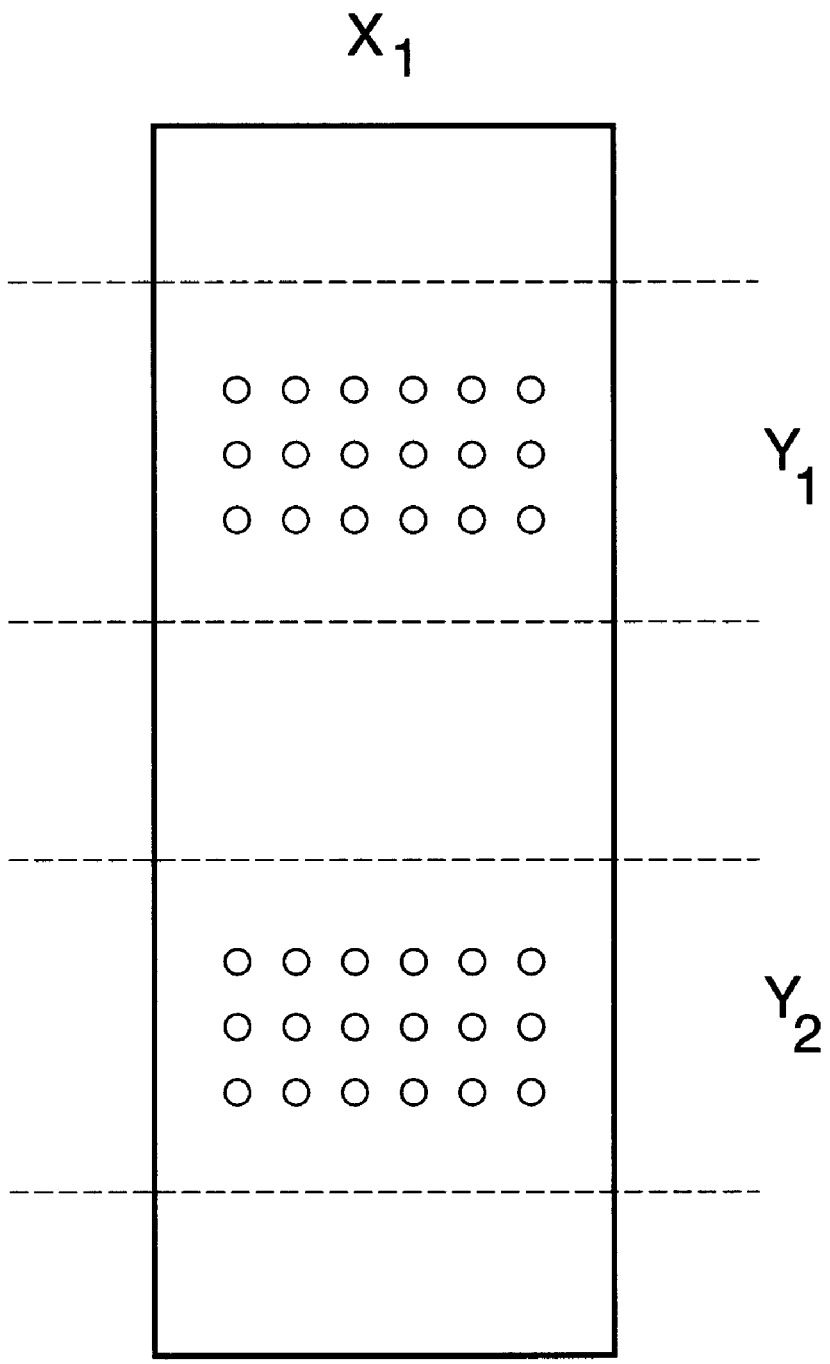
FIG. 23 illustrates perforations through a grid structure.

Referring next to FIG. 22, there is illustrated matrix-addressable display 2201, where anode 600 described above is mechanically coupled to grid 2000 and to the cathode described above with respect to FIG. 18. Note that the height parameter designated as h may be anywhere from 0 to some positive number depending on whether or not it is desired for grid 2000 to rest on top of diamond layer 1801 or not. Display 2201 is produced in a manner similar to that described above with respect to FIG. 6.

Grid 2000 may be replaced with grid 2100 (FIG. 21), which is essentially similar to grid 2000 except that additional layers 2101 and 2102 have been added. Layer 2101 comprises an additional metal layer, while layer 2102 may comprise a dielectric. Grid 2100 combined with the cathode and anode of FIG. 22 results in a tetrode arrangement for display 2201.

Although the present invention and its advantages have been described in detail, it should be understood that various changes, substitutions and alterations can be made herein without departing from the spirit and scope of the invention as defined by the appended claims.

What is claimed is:

1. A field emission device comprising:

an anode assembly; and a cathode assembly, wherein the cathode assembly further comprises:

a substrate;

a plurality of electrically conducting strips deposited on the substrate; and a continuous layer of diamond material deposited over the plurality of electrically conducting strips and portions of the substrate exposed between the plurality of electrically conducting strips.

2. The field emission device as recited in claim 1, further including a grid assembly comprising:

a perforated silicon substrate;

a first dielectric layer deposited on the silicon substrate; and a first conducting layer deposited on the first dielectric layer, wherein the first dielectric layer and the first conducting layer have perforations coinciding with perforations of the silicon substrate.

3. The field emission device as recited in claim 2, wherein the grid assembly further comprises a second dielectric layer deposited on an underside of the silicon substrate, wherein the second dielectric layer has perforations coinciding with perforations of the silicon substrate.

4. The field emission device as recited in claim 3, wherein a width of each perforation is approximately equal to a total height of the perforation.

5. The field emission device as recited in claim 3, further comprising a second conducting layer deposited on the second dielectric layer.

6. The field emission device as recited in claim 2, wherein the grid perforations correspond in location to the electrically conducting strips deposited on the substrate.

7. A display comprising a plurality of field emission lamps each comprising:

an anode assembly;

a cathode assembly, wherein the cathode assembly further comprises:

a substrate;

an electrically conducting layer deposited on the substrate; and a layer of diamond material deposited over the electrically conducting layer; and circuitry for individually driving each of the plurality of field emission lamps.

8. The display as recited in claim 7, further including a grid assembly comprising:

a perforated silicon substrate;

a first dielectric layer deposited on the silicon substrate; and a first conducting layer deposited on the first dielectric layer, wherein the first dielectric layer and the first conducting layer have perforations coinciding with perforations of the silicon substrate.

9. The display as recited in claim 8, wherein the grid assembly further comprises a second dielectric layer deposited on an underside of the silicon substrate, wherein the second dielectric layer has perforations coinciding with perforations of the silicon substrate.

10. The display as recited in claim 9, wherein a width of each grid perforation is approximately equal to a total height of the perforation.

11. The display as recited in claim 9, further comprising a second conducting layer deposited on the second dielectric layer.

12. A data processing system, comprising:

a processor;

an input device;

a memory device;

a display; and a bus system coupling the processor to the input device, the memory device, and the display, wherein the display further comprises:

an anode assembly; and a cathode assembly, wherein the cathode assembly further comprises:

a substrate;

an electrically conducting layer deposited on the substrate; and a layer of diamond material deposited over the electrically conducting layer.

13. The system as recited in claim 12, further including a grid assembly comprising:

a perforated silicon substrate;

a first dielectric layer deposited on the silicon substrate; and a first conducting layer deposited on the first dielectric layer, wherein the first dielectric layer and the first conducting layer have perforations coinciding with perforations of the silicon substrate.

14. The system as recited in claim 13, wherein the grid assembly further comprises a second dielectric layer deposited on an underside of the silicon substrate, wherein the second dielectric layer has perforations coinciding with perforations of the silicon substrate.

15. The system as recited in claim 14, wherein a width of each grid perforation is approximately equal to a total height of the perforation.

16. The system as recited in claim 14, further comprising a second conducting layer deposited on the second dielectric layer.

17. The system as recited in claim 13, wherein the display is an LCD, wherein the anode assembly, the grid assembly, and the cathode assembly operate as a backlight for the LCD.

18. The system as recited in claim 13, wherein the anode assembly, the grid assembly, and the cathode assembly operate as a field emission lamp, and wherein the display comprises a plurality of individually addressable field emission lamps.

* * * * *